US010101679B2

(12) United States Patent
Maeda et al.

(10) Patent No.: US 10,101,679 B2
(45) Date of Patent: Oct. 16, 2018

(54) ELECTROPHOTOGRAPHIC PHOTOCONDUCTOR AND IMAGE FORMING APPARATUS

(71) Applicant: Konica Minolta, Inc., Tokyo (JP)

(72) Inventors: Seisuke Maeda, Tokyo (JP); Kazunori Kurimoto, Tokyo (JP); Kazuhiro Kuramochi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/345,993

(22) Filed: Nov. 8, 2016

(65) Prior Publication Data

US 2017/0131645 A1 May 11, 2017

(30) Foreign Application Priority Data

Nov. 11, 2015 (JP) ..... 2015-221165

(51) Int. Cl.

| | |
|---|---|
| ***G03G 5/147*** | (2006.01) |
| ***G03G 5/05*** | (2006.01) |
| ***G03G 5/047*** | (2006.01) |

(52) U.S. Cl.

CPC ..... *G03G 5/14717* (2013.01); *G03G 5/047* (2013.01); *G03G 5/0507* (2013.01); *G03G 5/0517* (2013.01); *G03G 5/14704* (2013.01); *G03G 5/14708* (2013.01)

(58) Field of Classification Search

CPC ..... G03G 5/14704; G03G 5/14708; G03G 5/0507; G03G 5/0517; G03G 5/047; G03G 5/14717; G03G 5/14734

USPC ..... 430/58.05, 66, 67, 71, 72

See application file for complete search history.

(56) References Cited

U.S. PATENT DOCUMENTS 5,357,320 A * 10/1994 Kashimura ..... G03G 5/0539 399/159
5,430,526 A * 7/1995 Ohkubo ..... G03G 15/0233 399/159
5,695,898 A * 12/1997 Go ..... G03G 5/14795 399/159

FOREIGN PATENT DOCUMENTS

| | | | |
|---|---|---|---|
| JP | S64-048065 | A | 2/1989 |
| JP | H01-283564 | A | 11/1989 |
| JP | H05-257315 | A | 10/1993 |
| JP | 2007064998 | A | 3/2007 |
| JP | 2011-107363 | A | 6/2011 |
| JP | 2012-189976 | A | 10/2012 |
| JP | 2014142571 | A | 8/2014 |

OTHER PUBLICATIONS

Japanese Patent Office J-PlatPat machine-assisted English-language translation of Japanese Patent Document JP 2012-189976 (pub. Oct. 2012).*

Notice of Reasons for Rejection dated Dec. 19, 2017 from the corresponding Japanese Application No. JP 2015-221165 and English translation.

Decision of Rejection dated May 8, 2018 from the corresponding Japanese Patent Application No. JP 2015-221165 and English translation.

* cited by examiner

*Primary Examiner* — Janis L Dote

(74) *Attorney, Agent, or Firm* — Lucas & Mercanti, LLP

(57) ABSTRACT

Provided is an electrographic photoconductor resistant to surface discharge and having good wear resistance. The electrographic photoconductor has a conductive support and a photosensitive layer disposed on the conductive support, the photosensitive layer containing a charge generation material and a charge transport material. A layer forming the surface of the electrographic photoconductor contains a resin binder forming the layer and a layered carbide dispersed in the resin binder. The layer forming the surface has a light transmittance in the range of 20 to 98% at a wavelength of 350 to 800 nm.

12 Claims, 2 Drawing Sheets

ELECTROPHOTOGRAPHIC PHOTOCONDUCTOR AND IMAGE FORMING APPARATUS

CROSS REFERENCE TO RELATED APPLICATIONS

This application is entitled to and claims the benefit of Japanese Patent Application No. 2015-221165, filed on Nov. 11, 2015, the disclosure of which including the specification, drawings and abstract is incorporated herein by reference in its entirety.

BACKGROUND OF THE INVENTION

1. Field of the Invention

The present invention relates to an electrographic photoconductor and an image forming apparatus having the electrographic photoconductor.

2. Description of Related Art

Electrophotographic image forming apparatuses use an electrographic photoconductor (which may hereinafter be simply referred to as "photoconductor") to form an electrostatic latent image to be developed into an image to be formed. Such an electrophotographic image forming apparatus first applies light to the charged photoconductor to form the electrostatic latent image. Next, the apparatus feeds a toner to the photoconductor to form a toner image based on the electrostatic latent image. The apparatus finally fixes the toner image onto a recording medium such as paper.

Known examples of the technique used in electrophotography to charge a photoconductor include a contact type charging technique using a charging roller or charging brush (this technique may hereinafter be simply referred to as "roller charging system etc.") and a non-contact type charging technique using a wire or the like (this technique may hereinafter be simply referred to as "scorotron charging system"). The roller charging system etc. make use of nearby discharge and cause a greater deterioration of the surface of the photoconductor at the charging than the scorotron charging system. In the roller charging system etc., high-energy charged objects such as electrons resulting from nearby discharge collide with the surface of the photoconductor to charge the photoconductor. At this charging, discharge of the photoconductor penetrates in the direction in which the layers of the photoconductor are stacked, thereby deteriorating the photoconductor. To address such deterioration of photoconductors, photoconductors have been known which contain a layered compound added to physically block the penetration of discharge (see Japanese Patent Application Laid-Open No. 2007-064998 and Japanese Patent Application Laid-Open No. 2014-142571, for example).

The photoconductor described in Japanese Patent Application Laid-Open No. 2007-064998 has a conductive layer, a charge generation layer disposed on the conductive layer, a charge transport layer disposed on the charge generation layer, and a protective layer disposed on the charge transport layer. The photoconductor contains a thermosetting or thermoplastic resin and a flat inorganic filler. The flat inorganic filler is a layered clay compound such as smectite, mica, or vermiculite.

The photoconductor described in Patent Application Laid-Open No. 2014-142571 has a support, a photosensitive layer disposed on the support, and a surface layer disposed on the photosensitive layer. The surface layer contains: an organic-inorganic hybrid material containing an inorganic component and an organic polymer; and a clay mineral. The clay mineral is montmorillonite, hectorite, vermiculite, attapulgite, sepiolite, or the like.

The photoconductors described in Japanese Patent Application Laid-Open No. 2007-064998 and Japanese Patent Application Laid-Open No. 2014-142571 may fail to sufficiently block the penetration of discharge, due to narrow spread of the flat inorganic filler or clay mineral in the surface layer.

SUMMARY OF THE INVENTION

It is therefore an object of the present invention to provide an electrographic photoconductor resistant to surface discharge and having good wear resistance and an image forming apparatus having the electrographic photoconductor.

To achieve at least one of the abovementioned objects, an electrographic photoconductor reflecting one aspect of the present invention includes a conductive support and a photosensitive layer disposed on the conductive support, the photosensitive layer containing a charge generation material and a charge transport material, wherein a layer forming the surface of the electrographic photoconductor contains a resin binder forming the layer and a layered carbide dispersed in the resin binder, and the layer forming the surface has a light transmittance in the range of 20 to 98% at a wavelength of 350 to 800 nm.

Also, to achieve at least one of the abovementioned objects, an image forming apparatus reflecting another aspect of the present invention includes an electrographic photoconductor according to an embodiment of the present invention; a charging device that charges the surface of the electrographic photoconductor; a light exposing device that applies light to the charged surface of the electrographic photoconductor to form an electrostatic latent image; a developing device that feeds a toner to the electrographic photoconductor having the electrostatic latent image formed thereon to form a toner image; and a transfer device that transfers the toner image from the surface of the electrographic photoconductor to a recording medium, wherein the charging device is a contact type charging device that contacts the surface of the electrographic photoconductor to apply a charging voltage.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Embodiments of the present invention will hereinafter be described in detail with reference to the accompanying drawings.

Embodiment 1

Configuration of Image Forming Apparatus

Figure 1:
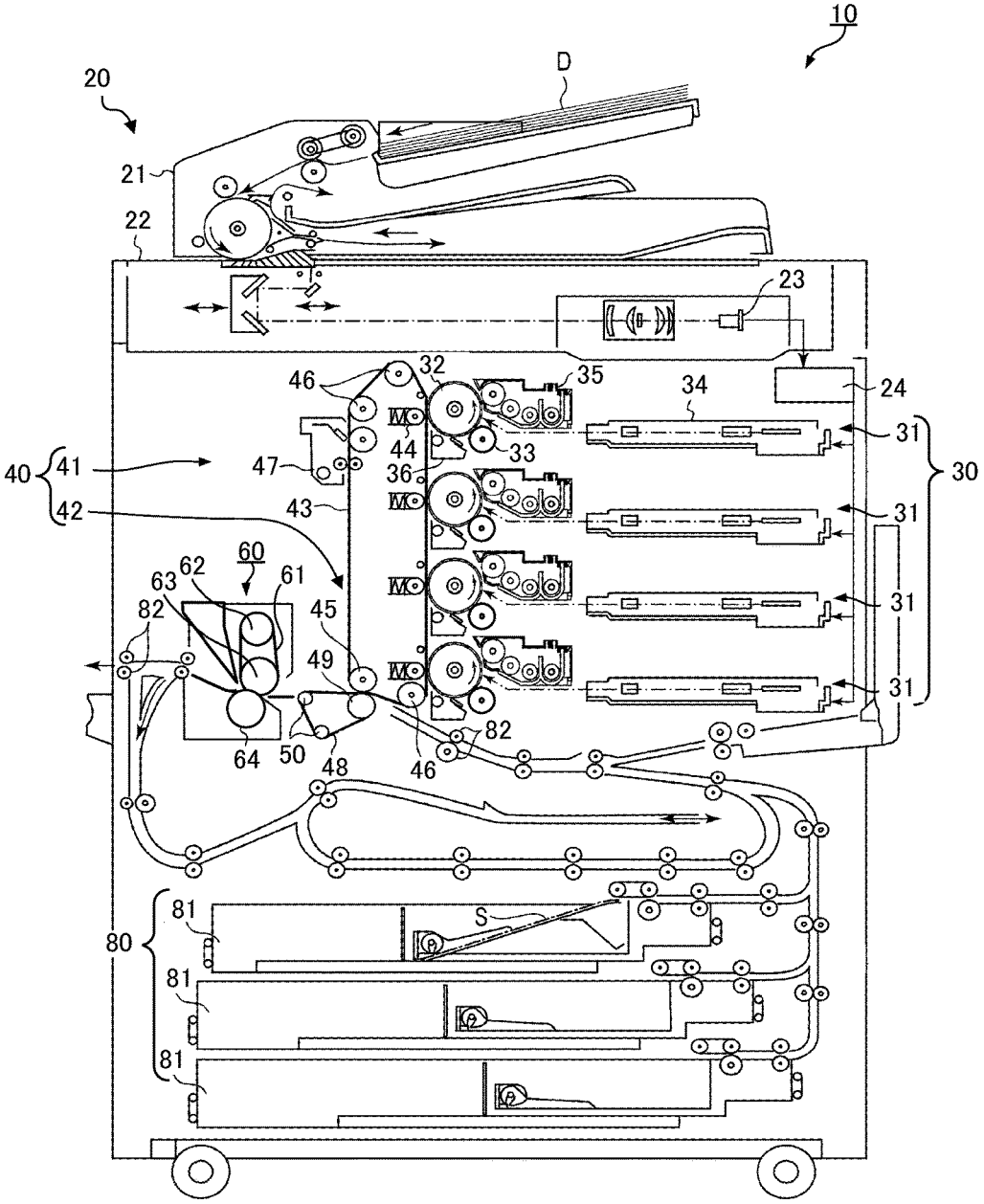
FIG. 1 is a diagram showing the configuration of an image forming apparatus according to Embodiment 1 of the present invention.

FIG. 1 is a diagram showing the configuration of image forming apparatus 10.

As shown in FIG. 1, image forming apparatus 10 has image reading section 20, image forming section 30, intermediate transfer section 40, fixing device 60, and recording medium conveyance section 80.

Image reading section 20 reads an image from original copy D to obtain image data for forming an electrostatic latent image. Image reading section 20 has sheet feed device 21, scanner 22, CCD sensor 23, and image processing section 24.

Image forming section 30 includes, for example, four image forming units 31 dedicated for yellow, magenta, cyan, and black colors, respectively. Each image forming unit 31 has photoconductor (electrographic photoconductor) 32, charging device 33, light exposing device 34, developing device 35, and cleaning device 36.

Photoconductor 32 is a negative charge type organic photoconductor having photoconductivity. Photoconductor 32 is charged by charging device 33. Charging device 33 is a contact type charging device that brings a contact charging member such as a charging roller or charging brush into contact with photoconductor 32 to charge photoconductor 32. Charging device 33 is, for example, a roller charging device that uses a charging roller to accomplish contact charging. Such a contact type charging device causes nearby discharge when charging photoconductor 32. The nearby discharge can deteriorate photoconductor 32 by acting on the surface of photoconductor 32. The present embodiment is designed to reduce the deterioration of photoconductor 32 even when nearby discharge occurs. One of the features of the present embodiment lies in photoconductor 32, and the details of photoconductor 32 will be described later.

Light exposing device 34 applies light to charged photoconductor 32 to form an electrostatic latent image. Light exposing device 34 is, for example, a semiconductor laser. Developing device 35 feeds a toner to photoconductor 32 having the electrostatic latent image formed thereon and forms a toner image based on the electrostatic latent image. Developing device 35 is, for example, a developing device commonly known to be used in electrophotographic image forming apparatuses. Cleaning device 36 removes the remaining toner from photoconductor 32. The "toner image" as defined herein refers to a toner aggregated in the form of an image.

The toner used can be a commonly known toner. The toner may be a one-component developer or two-component developer. The one-component developer is composed of toner particles. The two-component developer is composed of toner particles and carrier particles. Each toner particle is composed of a toner base particle and an external additive such as silica attached to the surface of the toner base particle. The toner base particle is composed, for example, of a binding resin, a colorant, and a wax.

Intermediate transfer section 40 includes primary transfer unit 41 and secondary transfer unit 42.

Primary transfer unit 41 has intermediate transfer belt 43, primary transfer roller 44, backup roller 45, a plurality of first support rollers 46, and cleaning device 47. Intermediate transfer belt 43 is an endless belt. Intermediate transfer belt 43 is supported on and extends between backup roller 45 and first support rollers 46. At least one of backup roller 45 and first support rollers 46 rotates to drive intermediate transfer belt 43 so that intermediate transfer belt 43 runs in one direction at a constant speed on the endless path.

Secondary transfer unit 42 has secondary transfer belt 48, secondary transfer roller 49, and a plurality of second support rollers 50. Secondary transfer belt 48 is an endless belt. Secondary transfer belt 48 is supported on and extends between secondary transfer roller 49 and second support rollers 50.

Fixing device 60 has fixing belt 61, heating roller 62, first pressure roller 63, second pressure roller 64, a heater, a temperature sensor, an air-injection separating device, a guide plate, and a guide roller.

Fixing belt 61 has a base layer, an elastic layer, and a releasing layer stacked in the order mentioned. Fixing belt 61 is rotatably supported by heating roller 62 and first pressure roller 63 in such a manner that the base layer faces inward and the releasing layer faces outward.

Heating roller 62 has a freely rotatable aluminum sleeve and a heater disposed within the sleeve. First pressure roller 63 has, for example, a freely rotatable metal shaft and an elastic layer disposed on the outer peripheral surface of the metal shaft.

Second pressure roller 64 is disposed to face first pressure roller 63 across fixing belt 61. Second pressure roller 64 is disposed to freely move close to or away from first pressure roller 63. When having moved close to first pressure roller 63, second pressure roller 64 forms a fixing nip section where second pressure roller 64 comes into contact with fixing belt 61 in such a manner as to press the elastic layer of first pressure roller 63 with fixing belt 61 interposed therebetween.

The air-injection separating device is a device that produces an air stream flowing from the downward side in the moving direction of fixing belt 61 toward the fixing nip section to facilitate the separation of recording medium S from fixing belt 61.

The guide plate is a member that guides, to the fixing nip section, recording medium S having the toner image that has yet to be fixed. The guide roller is a member that guides the recording medium having the toner image fixed thereon to the outside of image forming apparatus 10 from the fixing nip section.

Recording medium conveyance section 80 has three sheet feed tray units 81 and a plurality of registration roller pairs 82. Each sheet feed tray unit 81 contains a predetermined type of recording medium (standard paper, specialized paper, or the like in the present embodiment) S classified according to the basis weight, size, and the like. Registration roller pairs 82 are arranged to form a desired conveyance path.

Such image forming apparatus 10 first applies light to charged photoconductor 32 to form an electrostatic latent image, and then feeds a toner to photoconductor 32 to form a toner image based on the electrostatic latent image. Recording medium conveyance section 80 delivers recording medium S to intermediate transfer section 40, which transfers the toner image onto recording medium S. After intermediate transfer section 40 transfers the toner image onto recording medium S, fixing device 60 fixes the toner image on recording medium S. The recording medium having the toner image fixed thereon is guided by registration roller pairs 82 to the outside of image forming apparatus 10.

(Structure of Photoconductor)

Figure 2:
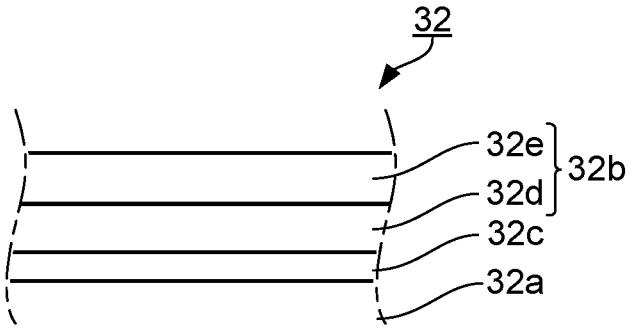
FIG. 2 is a partial cross-sectional view of a photoconductor according to Embodiment 1 of the present invention.

Next, photoconductor 32 will be described in detail. FIG. 2 is a partial cross-sectional view of photoconductor 32.

As shown in FIG. 2, photoconductor 32 has conductive support 32*a* and photosensitive layer 32*b* disposed on conductive support 32*a*, photosensitive layer 32*b* containing a charge generation material and a charge transport material. Photoconductor 32 may have intermediate layer 32*c* between conductive support 32*a* and photosensitive layer 32*b*. Photosensitive layer 32*b* may be a single layer containing a charge transport material and a charge generation material or may be a two-layered structure including a charge generation layer containing a charge generation material and a charge transport layer containing a charge transport material. In the present embodiment, photosensitive layer 32*b* is a two-layered structure having charge generation layer 32*d* and charge transport layer 32*e* disposed on charge generation layer 32*d*. That is, the "layer forming the surface of the electrographic photoconductor" in the present embodiment is charge transport layer 32*e*.

Conductive support 32*a* is a conductive member that supports photosensitive layer 32*b*, with intermediate layer 32*c* interposed therebetween. Examples of conductive support 32*a* include a metal drum, a metal sheet, a plastic film having a metal foil laminated thereon, a plastic film having a conductive material deposited thereon, and a metal member, plastic film, or paper coated with a paint containing a conductive material. The metal is not particularly limited and may be any metal having conductivity. Examples of the metal include aluminum, copper, chromium, nickel, zinc, and stainless steel. Examples of the conductive material include metals, indium oxide, and tin oxide. In the present embodiment, conductive support 32*a* is an aluminum drum. The thickness of the peripheral wall of conductive support 32*a* is, for example, 0.1 mm.

Intermediate layer 32*c* is a layer that functions as a barrier and adhesive for conductive support 32*a*. For example, intermediate layer 32*c* has a resin binder and conductive particles dispersed in the resin binder. The thickness of intermediate layer 32*c* is, for example, 0.1 to 15 μm and more preferably 0.3 to 10 μm.

Examples of the resin binder include casein, polyvinyl alcohol, nitrocellulose, ethylene-acrylic acid copolymer, polyamide, polyurethane, and gelatin. Examples of the conductive particles include: particles of metal oxides such as alumina, zinc oxide, titanium oxide, tin oxide, antimony oxide, indium oxide, and bismuth oxide; and ultrafine particles of tin-doped indium oxide, antimony-doped tin oxide, zirconium oxide, and the like. Intermediate layer 32*c* is fabricated, for example, by dip coating in which conductive support 32*a* is dipped in a solution of the resin binder containing the conductive particles dispersed therein.

Photosensitive layer 32*b* is a layer on the surface of which image forming apparatus 10 described above forms an electrostatic latent image for a desired image by exposure. In the present embodiment, photosensitive layer 32*b* has a structure made up of charge generation layer 32*d* and charge transport layer 32*e*.

Charge generation layer 32*d* has, for example, a resin binder and a charge generation material dispersed in the resin binder. The thickness of charge generation layer 32*d* is not particularly limited. The thickness of charge generation layer 32*d* is, for example, in the range of 0.01 to 5 μm and more preferably in the range of 0.05 to 3 μm.

Examples of the resin binder include polystyrene resins, polyethylene resins, polypropylene resins, acrylic resins, methacrylic resins, vinyl chloride resins, vinyl acetate resins, polyvinyl butyral resins, epoxy resins, polyurethane resins, phenolic resins, polyester resins, alkyd resins, polycarbonate resins, silicone resins, melamine resins, copolymer resins including two or more of the above resins (e.g., a vinyl chloride-vinyl acetate copolymer resin and a vinyl chloride-vinyl acetate-maleic anhydride copolymer resin), and polyvinyl carbazole resins. Examples of the charge generation material include: azo pigments such as Sudan Red and Diane Blue; quinone pigments such as pyrenequinone and anthanthrone; quinocyanine pigments; perylene pigments; indigo pigments such as indigo and thioindigo; and phthalocyanine pigments. Charge generation layer 32*d* is fabricated, for example, by dip coating in which conductive support 32*a* having intermediate layer 32*c* formed thereon is dipped in a solution of the resin binder containing the charge generation material dispersed therein.

Examples of the charge generation material include: azo pigments such as Sudan Red and Diane Blue; quinone pigments such as pyrenequinone and anthanthrone; quinocyanine pigments; perylene pigments; indigo pigments such as indigo and thioindigo; and phthalocyanine pigments. The substances mentioned above may be used alone or in combination of two or more as the charge generation material.

Charge transport layer 32*e* has a resin binder, a layered carbide dispersed in the resin binder, and a charge transport material dispersed in the resin binder. The thickness of charge transport layer 32*e* is, for example, 5 to 40 μm and more preferably 10 to 30 μm. The light transmittance of charge transport layer 32*e* at a wavelength of 350 to 800 nm is in the range of 20 to 98%.

The resin binder is a thermoplastic resin or thermosetting resin. Examples of the resin binder include polystyrene resins, acrylic resins, methacrylic resins, vinyl chloride resins, vinyl acetate resins, polyvinyl butyral resins, epoxy resins, polyurethane resins, phenolic resins, polyester resins, alkyd resins, polycarbonate resins, silicone resins, and melamine resins. The resin binder may be a copolymer including repeating units corresponding to those of two or more of the resin binders mentioned above. The resin binder is preferably a polycarbonate resin which has low water absorbency and high mechanical strength.

The layered carbide is a conductive material that physically prevents the penetration of discharge into charge transport layer 32*e* caused by nearby discharge during charging photoconductor 32. The layered carbide is not particularly limited insofar as it can perform the above function. Examples of the layered carbide include graphene, graphite, and polycyclic aromatic hydrocarbons such as anthracene, naphthacene, pyrene, perylene, triphenylene, coronene, and ovalene which have three or more condensed aromatic rings. The layered carbide particularly preferably includes graphene as a structural unit. That is, the layered carbide is preferably graphene or graphite.

The thickness of the layered carbide is preferably in the range of 0.5 to 100 nm. If the thickness of the layered carbide is less than 0.5 nm, the layered carbide may fail to withstand discharge during charging photoconductor 32. If the thickness of the layered carbide is more than 100 nm, the layered carbide may hinder curing during formation of charge transport layer 32*e*, resulting in a reduction in the strength of the layer.

The size of the layered carbide can be specified by its particle size. The "particle size of the layered carbide" as defined herein is a representative value representing the size of the layered carbide. The representative value may be a mean value, a maximum diameter (maximum dimension), a catalog value, or an actual measured value.

In the present embodiment, the maximum diameter (longitudinal diameter) of the layered carbide is preferably in the range of 0.1 to 50 μm. If the maximum diameter of the layered carbide is less than 0.1 μm, the layered carbide may fail to provide the desired effect. If the maximum diameter of the layered carbide is more than 50 μm, the layered carbide may cause the charge generated in charge generation layer 32*d* to move in the plane direction, leading to a failure of charging.

To distribute the layered carbide uniformly in the plane direction of charge transport layer 32*e*, the ratio of the maximum dimension to the minimum dimension (aspect ratio) of the layered carbide in the plane direction of the layered carbide is preferably in the range of 1 to 10.

As previously described, the light transmittance of charge transport layer 32*e* at a wavelength of 350 to 800 nm is in the range of 20 to 98%. If the light transmittance at a wavelength of 350 to 800 nm is less than 20%, charge transport layer 32*e* may fail to perform its function. If the light transmittance at a wavelength of 350 to 800 nm is more than 80%, the layered carbide may fail to provide the desired effect. The light transmittance of charge transport layer 32*e* at a wavelength of 350 to 800 nm can be optionally adjusted by changing the size or amount of the layered carbide.

The amount of the layered carbide contained in charge transport layer 32*e* is preferably in the range of 0.05 to 20 parts by weight per 100 parts by weight of the resin binder. If the amount of the added layered carbide is less than 0.05 parts by weight per 100 parts by weight of the resin binder, the layered carbide may fail to provide the desired effect. If the amount of the layered carbide added is more than 20 parts by weight per 100 parts by weight of the resin binder, the effect of the layered carbide may reach a plateau, in addition to which the production cost may increase.

When the light transmittance of charge transport layer 32*e* included in photoconductor 32 is to be measured, for example, the absorbance of the surface of photoconductor 32 having charge transport layer 32*e* is first measured using a predetermined wavelength within the wavelength range from 350 to 800 nm. Next, charge transport layer 32*e* is scraped from photoconductor 32, and the absorbance of the surface of photoconductor 32 is then measured using the predetermined wavelength. Finally, the difference between the absorbances measured before and after the scraping of charge transport layer 32*e* is determined. The difference in absorbance thus determined corresponds to the absorbance of charge transport layer 32*e*. A calibration curve of the amount of the layered carbide to be contained in charge transport layer 32*e* versus the absorbance at the predetermined wavelength is created beforehand. The amount of the contained layered carbide can be estimated from the difference in absorbance (the absorbance of charge transport layer 32*e*) on the basis of the created calibration curve. When the material composition of the layer (charge transport layer 32*e*) forming the surface of photoconductor 32 is known, charge transport layer 32*e* may be formed alone by applying and curing a resin binder solution containing the above-described layered carbide dispersed therein, and the light transmittance of charge transport layer 32*e* thus formed may be measured by an existing apparatus.

Charge transport layer 32*e* is fabricated, for example, by dip coating in which conductive support 32*a* having charge generation layer 32*d* formed thereon is dipped in a resin binder solution containing the above-described layered carbide dispersed therein, or by applying a resin binder solution containing the above-described layered carbide dispersed therein to charge generation layer 32*d* and drying the solution on charge generation layer 32*d*. When charge transport layer 32*e* is formed in this manner, the plane direction of the layered carbide and the plane direction of charge transport layer 32*e* approximately coincide with each other. This can effectively prevent the deterioration of photoconductor 32 caused by nearby discharge.

Charge transport layer 32*e* can contain an optional component to the extent that the component does not impair the function of charge transport layer 32*e*. Charge transport layer 32*e* may contain, for example, metal oxide particles having a surface layer composed of a residue of a surface treating agent having a crosslinkable reactive group.

Embodiment 2

Next, an image forming apparatus according to Embodiment 2 will be described. The image forming apparatus according to Embodiment 2 differs from image forming apparatus 10 according to Embodiment 1 only by the structure of photoconductor 132. In Embodiment 2, therefore, photoconductor 132 will only be described.

Figure 3:
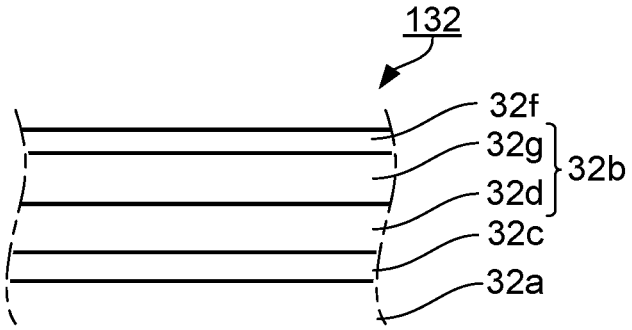
FIG. 3 is a partial cross-sectional view of a photoconductor according to Embodiment 2 of the present invention.

FIG. 3 is a partial cross-sectional view of photoconductor 132 according to Embodiment 2. As shown in FIG. 3, photoconductor 132 according to Embodiment 2 has conductive support 32*a*, photosensitive layer 32*b*, and surface layer 32*f* Photosensitive layer 32*b* has charge generation layer 32*d* and charge transport layer 32*g*. Thus, the "layer forming the surface of the electrographic photoconductor" in the present embodiment is surface layer 32*f*.

The function and features of conductive support 32*a* and charge generation layer 32*d* in Embodiment 2 are the same as those in Embodiment 1.

Charge transport layer 32*g* in photosensitive layer 32*b* has a resin binder and a charge transport material. The resin binder used can be a commonly known resin. Examples of the resin binder include polycarbonate resins, polyacrylate resins, polyester resins, polystyrene resins, styrene-acrylonitrile copolymer resins, polymethacrylate resins, and styrene-methacrylate copolymer resins. Among these, polycarbonate resins are preferred. In terms of crack resistance, wear resistance, and charging properties, polycarbonate resins such as those of the bisphenol A (BPA) type, bisphenol Z (BPZ) type, dimethyl BPA type, and BPA-dimethyl BPA copolymer type are more preferred. The charge transport material used can be the same as that in Embodiment 1.

Surface layer 32*f* is disposed on photosensitive layer 32*b* described above and protects photosensitive layer 32*b*. Surface layer 32*f* of photoconductor 132 reduces roughening and uneven wearing of photoconductor 132, and prevents deterioration of the resulting images due to poor cleaning. Surface layer 32*f* has a resin binder and a layered carbide dispersed in the resin binder. The resin binder forming surface layer 32*f* may be a cured product of any of the thermoplastic resins as mentioned above or may be a cured product of any of the thermosetting resins as mentioned above. The resin binder forming surface layer 32*f* may be any of a range of cured polymers (a range of polymers) resulting from polymerization of polymerizable compounds. The light transmittance of surface layer 32*f* at a wavelength of 350 to 800 nm is in the range of 20 to 98%.

The polymerizable compound for forming the cured polymer is, for example, a compound having two or more radical polymerizable functional groups. Examples of the radical polymerizable functional groups include vinyl, acryloyl, and methacryloyl groups. That is, surface layer 32*f* is formed of an integral polymer resulting from radical polymerization of a monomer having radical polymerizable functional groups, and has a layered carbide dispersed in surface layer 32*f*.

The polymerizable compound is, for example, any of the following compounds M1 to M15.

[Formula 1]

M1

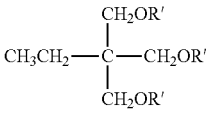

M2

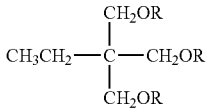

M3

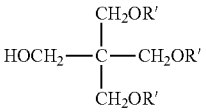

M4

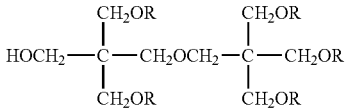

M5

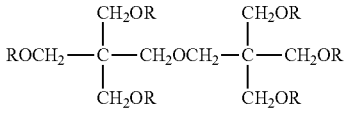

M6

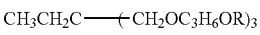

M7

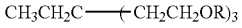

[Formula 2]

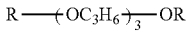

M8

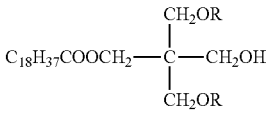

M9

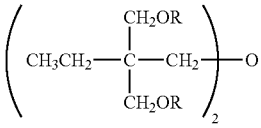

M10

M11

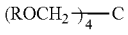

M12

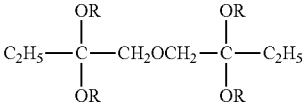

M13

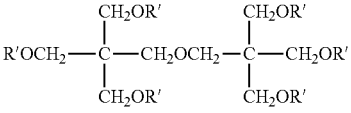

M14

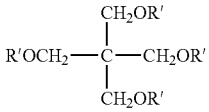

-continued

M15

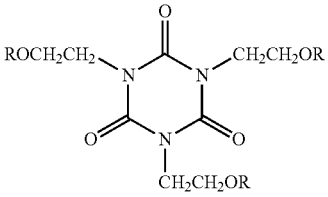

The layered carbide dispersed in the resin binder can be the layered carbide as described in Embodiment 1. The light transmittance of surface layer 32*f* at a wavelength of 350 to 800 nm is in the range of 20 to 98%. In surface layer 32*f*, the amount of the layered carbide is preferably in the range of 0.05 to 20 parts by weight per 100 parts by weight of the resin binder. The light transmittance of surface layer 32*f* at the above wavelength can be determined in the same manner as described in Embodiment 1.

Surface layer 32*f* may contain, as an optional component, metal oxide particles having a surface layer composed of a residue of a surface treating agent having a crosslinkable reactive group (the metal oxide particles may hereinafter be simply referred to as "surface-treated metal oxide particles"). The "residue of a surface treating agent having a crosslinkable reactive group" as defined herein refers to a structure chemically bonded to both the metal oxide particles and resin binder and present between the metal oxide particles and resin binder. Examples of the metal oxide particles include particles of tin oxide, titanium oxide, and copper aluminate. In terms of hardness, conductivity, and light transmittance, the metal oxide particles are preferably particles of tin oxide.

The number average primary particle size of the metal oxide particles is preferably in the range of 1 to 300 nm, more preferably in the range of 3 to 100 nm, and even more preferably in the range of 5 to 40 nm. The primary particle size of the surface-treated metal oxide particles and the primary particle size of the metal oxide particles can be considered identical.

The amount of the metal oxide particles is preferably in the range of 50 to 200 parts by weight and more preferably in the range of 70 to 180 parts by weight per 100 parts by weight of the resin binder described above. If the amount of the metal oxide particles is less than 50 parts by weight per 100 parts by weight of the resin binder, the electrical properties may be insufficient. If the amount of the metal oxide particles is more than 200 parts by weight per 100 parts by weight of the resin binder, the quality of coating formation may be poor, which leads to a failure to obtain a sufficient layer strength. The weight of the surface-treated metal oxide particles and the weight of the metal oxide particles can be considered identical.

Surface treatment of the metal oxide particles with a surface treating agent having a radical polymerizable functional group introduces the radical polymerizable functional group into the surfaces of the metal oxide particles. Due to being surface-treated with the surface treating agent, the metal oxide particles can react with a radical polymerizable compound to form a crosslinked structure during forming surface layer 32*f* in the production process of photoconductor 132, thus allowing charge transport layer 32*e* to have sufficient strength. In addition, the metal oxide particles can be well dispersed in the coating layer.

Examples of the radical polymerizable functional group of the surface treating agent include vinyl, acryloyl, and methacryloyl groups. Such a radical polymerizable functional group can react with the radical polymerizable compound for forming the resin binder and help to form surface layer 32*f* having high layer strength. A silane coupling agent having a polymerizable functional group such as a vinyl, acryloyl, or methacryloyl group is preferred as the surface treating agent having a radical polymerizable functional group.

Examples of the surface treating agent include the compounds listed as S-1 to S-36 in Table 1.

TABLE 1

| Surface treating agent No. | Surface treating agent |
|---|---|
| S-1 | $CH_2{=}CHSi(CH_3)(OCH_3)_2$ |
| S-2 | $CH_2{=}CHSi(OCH_3)_3$ |
| S-3 | $CH_2{=}CHSiCl_3$ |
| S-4 | $CH_2{=}CHCOO(CH_2)_2\ Si(CH_3)(OCH_3)_2$ |
| S-5 | $CH_2{=}CHCOO(CH_2)_2\ Si(OCH_3)_3$ |
| S-6 | $CH_2{=}CHCOO(CH_2)_2\ Si(OC_2H_5)(OCH_3)_2$ |
| S-7 | $CH_2{=}CHCOO(CH_2)_3\ Si(OCH_3)_3$ |
| S-8 | $CH_2{=}CHCOO(CH_2)_2\ Si(CH_3)Cl_2$ |
| S-9 | $CH_2{=}CHCOO(CH_2)_2\ SiCl_3$ |
| S-10 | $CH_2{=}CHCOO(CH_2)_3\ Si(CH_3)Cl_2$ |
| S-11 | $CH_2{=}CHCOO(CH_2)_3\ SiCl_3$ |
| S-12 | $CH_2{=}C(CH_3)COO(CH_2)_2\ Si(CH_3)(OCH_3)_2$ |
| S-13 | $CH_2{=}C(CH_3)COO(CH_2)_2\ Si(OCH_3)_3$ |
| S-14 | $CH_2{=}C(CH_3)COO(CH_2)_3\ Si(CH_3)(OCH_3)_2$ |
| S-15 | $CH_2{=}C(CH_3)COO(CH_2)_3\ Si(OCH_3)_3$ |
| S-16 | $CH_2{=}C(CH_3)COO(CH_2)_2\ Si(CH_3)Cl_2$ |
| S-17 | $CH_2{=}C(CH_3)COO(CH_2)_2\ SiCl_3$ |
| S-18 | $CH_2{=}C(CH_3)COO(CH_2)_3\ Si(CH_3)Cl_2$ |
| S-19 | $CH_2{=}C(CH_3)COO(CH_2)_3\ SiCl_3$ |
| S-20 | $CH_2{=}CHSi(C_2H_5)(OCH_3)_2$ |
| S-21 | $CH_2{=}C(CH_3)Si(OCH_3)_3$ |
| S-22 | $CH_2{=}C(CH_3)Si(OC_2H_5)_3$ |
| S-23 | $CH_2{=}CHSi(OCH_3)_3$ |
| S-24 | $CH_2{=}C(CH_3)Si(CH_3)(OCH_3)_2$ |
| S-25 | $CH_2{=}CHSi(CH_3)Cl_2$ |
| S-26 | $CH_2{=}CHCOOSi(OCH_3)_3$ |
| S-27 | $CH_2{=}CHCOOSi(OC_2H_5)_3$ |
| S-28 | $CH_2{=}C(CH_3)COOSi(OCH_3)_3$ |
| S-29 | $CH_2{=}C(CH_3)COOSi(OC_2H_5)_3$ |
| S-30 | $CH_2{=}C(CH_3)COO(CH_2)_3\ Si(OC_2H_5)_3$ |
| S-31 | $CH_2{=}CHCOO(CH_2)_2\ Si(CH_3)_2(OCH_3)$ |
| S-32 | $CH_2{=}CHCOO(CH_2)_2\ Si(CH_3)(OCOCH_3)_2$ |
| S-33 | $CH_2{=}CHCOO(CH_2)_2\ Si(CH_3)(ONHCH_3)_2$ |
| S-34 | $CH_2{=}CHCOO(CH_2)_2\ Si(CH_3)(OC_6H_5)_2$ |
| S-35 | $CH_2{=}CHCOO(CH_2)_2\ Si(C_{10}H_{21})(OCH_3)_2$ |
| S-36 | $CH_2{=}CHCOO(CH_2)_2\ Si(CH_2C_6H_5)(OCH_3)_2$ |

EXAMPLES

The present invention will hereinafter be described in more detail by way of examples, which are not intended to limit the present invention.

Example 1

In Example 1, photoconductors having a conductive support, an intermediate layer, and a photosensitive layer (photoconductors according to Embodiment 1) were tested for wear resistance, electrical properties, and cleaning properties.

1. Fabrication of Photoconductors (Fabrication of Photoconductor 1)

(1) Preparation of Conductive Support

The surface of an aluminum support in the shape of a drum (with an outer diameter Ø of 30 mm and a length of 360 mm) was machined to prepare a conductive support having a surface roughness Rz of 1.5 μm.

(2) Formation of Intermediate Layer

Next, the components listed below were dispersed together in the indicated amounts to prepare a first coating solution. This dispersing was performed using a sand mill as a dispersing machine in a batch manner for 10 hours.

| | |
|---|---|
| Polyamide resin | 1 part by weight |
| Titanium oxide | 1.1 parts by weight |
| Ethanol | 20 parts by weight |

The polyamide resin (resin binder) used was X 1010 (manufactured by Daicel Degussa Ltd.) and the titanium oxide (conductive particles) used was SMT 500SAS (manufactured by TAYCA CORPORATION). The number average primary particle size of the titanium oxide is 0.035 μm.

The first coating solution prepared was applied to the outer peripheral surface of the conductive support by dip coating and was dried in an oven at 110° C. for 20 minutes. A 2-μm-thick intermediate layer was thus formed on the surface of the conductive support.

(3) Formation of Charge Generation Layer

Next, the components listed below were mixed and dispersed together in the indicated amounts to prepare a second coating solution. This dispersing was performed using a sand mill as a dispersing machine for 10 hours.

| | |
|---|---|
| Titanyl phthalocyanine pigment | 20 parts by weight |
| Polyvinyl butyral resin | 10 parts by weight |
| t-butyl acetate | 700 parts by weight |
| 4-methoxy-4-methyl-2-pentanone | 300 parts by weight |

The titanyl phthalocyanine pigment (charge generation material) shows a maximum diffraction peak at least at 27.3° when subjected to Cu-Kα characteristic X-ray diffraction spectroscopy. The polyvinyl butyral resin (resin binder) used was #6000-C (manufactured by Denki Kagaku Kogyo K.K.).

The second coating solution prepared was applied onto the intermediate layer by dip coating and was dried in an oven at room temperature for 10 minutes. A 0.3-μm-thick charge generation layer was formed on the surface of the intermediate layer.

(4) Formation of Charge Transport Layer

Next, the components listed below were mixed and dissolved in the indicated amounts to prepare a third coating solution.

| | |
|---|---|
| Charge transport material | 70 parts by weight |
| Resin binder | 100 parts by weight |
| Layered carbide | 0.5 parts by weight |
| Antioxidant | 8 parts by weight |
| Tetrahydrofuran/toluene (weight ratio: 8/2) | 750 parts by weight |

The charge transport material used was 4-methoxy-4'-(4-methyl-α-phenylstyryl)triphenylamine. The resin binder used was bisphenol Z type polycarbonate (IUPILON-Z300; Mitsubishi Gas Chemical Company, Inc.). The layered carbide used was a graphene nanopowder whose particles have a longitudinal diameter of 5 μm (G-14; EM Japan Co., Ltd.). The antioxidant used was IRGANOX 1010 (manufactured by BASF SE; "IRGANOX" is the registered trademark of this company).

The third coating solution prepared was applied onto the charge generation layer by dip coating and was dried in an oven at 120° C. for 70 minutes. A 25-μm-thick charge transport layer was thus formed on the surface of the charge generation layer. A charge transport film was separately formed by applying and curing the third coating solution on a metal plate, and the light transmittance of the film at a wavelength of 780 nm was determined using an ultraviolet-visible-near-infrared spectrophotometer (UH 4150; Hitachi High-Tech Science Corporation).

Photoconductor 1 was fabricated by the steps described above.

(Photoconductor 2)

Photoconductor 2 was fabricated in the same manner as photoconductor 1, except for replacing layered carbide No.

1 with layered carbide No. 2 listed in Table 2. Layered carbide No. 2 used was a graphene nanopowder (G-33; EM Japan Co., Ltd.).

(Photoconductor 3)

Photoconductor 3 was fabricated in the same manner as photoconductor 1, except for replacing layered carbide No. 1 with layered carbide No. 3 with a thickness of 5 nm listed in Table 2. Layered carbide No. 3 used was a graphene nanoplatelet (G0441; Tokyo Chemical Industry Co., Ltd.).

(Photoconductor 4)

Photoconductor 4 was fabricated in the same manner as photoconductor 1, except for replacing layered carbide No. 1 with layered carbide No. 4 with a longitudinal diameter of 10 μm listed in Table 2. Layered carbide No. 4 used was a graphene nanopowder (G-12S; EM Japan Co., Ltd.).

(Photoconductor 5)

Photoconductor 5 was fabricated in the same manner as photoconductor 1, except for changing the amount of layered carbide No. 1 to 2.0 parts by weight as shown in Table 2.

(Photoconductor 6)

Photoconductor 6 was fabricated in the same manner as photoconductor 1, except for replacing layered carbide No. 1 with layered carbide No. 5 with a thickness of 100 nm listed in Table 2. Layered carbide No. 5 used was a graphene nanopowder (G-13S; EM Japan Co., Ltd.).

(Photoconductor 7)

Photoconductor 7 was fabricated in the same manner as photoconductor 1, except for not adding any layered carbide and adjusting the thickness of the charge transport layer to 40 μm as shown in Table 2.

(Photoconductor 8)

Photoconductor 8 was fabricated in the same manner as photoconductor 1, except for replacing layered carbide No. 1 with vermiculite listed in Table 2. The vermiculite used was MICRON 8 (Tomoe Engineering Co., Ltd.).

Table 2 lists the layered carbides and resin binder which were used to fabricate photoconductors 1 to 8, the thickness of the charge transport layers, and the light transmittance of the charge transport layers.

2. Evaluation of Photoconductors

The photoconductors were evaluated for wear resistance, electrical properties, and cleaning properties.

(1) Evaluation of Wear Resistance

Each of photoconductors 1 to 8 was mounted in a modified version of an image forming apparatus, "BIZHUB C554" (Konica Minolta Business Technologies, Inc.), and 30000 copies were printed under the conditions of a temperature of 23° C. and a humidity of 50% in a setting using a black toner. The amount of thickness decrease of the outermost layer of the photoconductor was determined to evaluate the wear resistance of the photoconductor. Specifically, before and after the printing of 30000 copies, the thickness of the outermost layer (the charge transport layer in the present example) was measured at 10 sites where the thickness was substantially uniform, and the average of the ten measured values was employed as the thickness of the outermost layer. The thickness measurement was conducted using an eddy current type film thickness meter (EDDY 560C; HELMUT FISCHER GMBTE CO Co., Ltd.). The sites where the thickness was substantially uniform were determined on the basis of an end-to-end thickness profile of the photoconductor. Photoconductors 1 to 8 were evaluated according to the following criteria.

A: The amount of thickness decrease is less than 0.3 μm (Excellent).

B: The amount of thickness decrease is 0.3 μm or more and less than 0.6 μm (Good).

C: The amount of thickness decrease is 0.6 μm or more and less than 1.0 μm (Practically acceptable).

D: The amount of thickness decrease is 1.0 μm or more (Practically unacceptable).

(2) Evaluation of Electrical Properties

Each of photoconductors 1 to 8 was mounted in a modified version of an image forming apparatus, "BIZHUB C554" (Konica Minolta Business Technologies, Inc.), and was exposed under the conditions of a temperature of 23° C.

TABLE 2

| | | Layered carbide | | | | | | |
|---|---|---|---|---|---|---|---|---|
| Category | Photoconductor No. | Layered carbide No. | Thickness (nm) | Longitudinal diameter (μm) | Amount (parts by weight) | Resin binder | Thickness of charge transport layer (μm) | Light transmittance (%) |
| Example | Photoconductor 1 | 1 | 20 | 5 | 0.5 | Z300 | 25 | 97.3 |
| | Photoconductor 2 | 2 | 20 | 50 | 0.5 | Z300 | 25 | 94.7 |
| | Photoconductor 3 | 3 | 5 | 5 | 0.5 | Z300 | 25 | 97.3 |
| | Photoconductor 4 | 4 | 20 | 10 | 0.5 | Z300 | 25 | 96.8 |
| | Photoconductor 5 | 1 | 20 | 5 | 2.0 | Z300 | 25 | 88.7 |
| | Photoconductor 6 | 5 | 100 | 5 | 0.5 | Z300 | 25 | 85.9 |
| Comparative Example | Photoconductor 7 | — | — | — | — | Z300 | 40 | 97.5 |
| | Photoconductor 8 | | Vermiculite | | 0.5 | Z300 | 25 | 83.5 |

and a humidity of 50%, with the initial potential set at 600±30 V. The surface potential of each photoconductor subjected to the exposure was then measured. Photoconductors 1 to 8 were evaluated according to the following criteria.

A: The surface potential is 60 V or less (Excellent).

B: The surface potential is more than 60 V and 90 V or less (Good).

C: The surface potential is more than 90 V and 120 V or less (Practically acceptable).

D: The surface potential is more than 120 V (Practically unacceptable).

(3) Evaluation of Cleaning Properties

Each of photoconductors 1 to 8 was mounted in a modified version of an image forming apparatus, "BIZHUB C554" (Konica Minolta Business Technologies, Inc.), and 2000 copies of a 5% coverage rate chart were printed under the condition of a temperature of 23° C. and a humidity of 50% in a setting using a black toner. After that, the outermost layer of the photoconductor was observed with a microscope to count the number of attached objects on the surface in a visual field of 20 mm×40 mm. Photoconductors 1 to 8 were evaluated according to the following criteria.

A: No attached objects were detected (Excellent).

B: 1 to 5 attached objects were detected (Good).

C: 6 to 10 attached objects were detected (Practically acceptable).

D: 11 or more attached objects were detected (Practically unacceptable).

For photoconductors 1 to 8, Table 3 shows the category, the photoconductor number, the evaluation results of wear resistance, the evaluation results of electrical properties, and the evaluation results of cleaning properties.

TABLE 3

| | | Evaluation items | | |
|---|---|---|---|---|
| Category | Photoconductor No. | Wear resistance | Electrical properties | Cleaning properties |
| Example | Photoconductor 1 | C | A | A |
| | Photoconductor 2 | C | A | B |
| | Photoconductor 3 | C | A | A |
| | Photoconductor 4 | C | B | A |
| | Photoconductor 5 | C | A | B |
| | Photoconductor 6 | C | B | B |
| Comparative Example | Photoconductor 7 | D | B | D |
| | Photoconductor 8 | D | D | D |

As shown in Table 3, photoconductor 7 according to Comparative Example had poor wear resistance and poor cleaning properties due to the charge transport layer containing no layered carbide. Photoconductor 8 according to Comparative Example, which contained vermiculite instead of any layered carbide, had poor wear resistance, poor electrical properties, and poor cleaning properties. The poor wear resistance of photoconductor 8 according to Comparative Example was attributed to the fact that the vermiculite has lower strength than the layered carbides. The poor electrical properties of photoconductor 8 according to Comparative Example were attributed to the fact that the conductivity of the vermiculite is lower than the conductivity of the layered carbides. The poor cleaning properties were attributed to the fact that the vermiculite has higher polarity than the layered carbides.

By contrast, photoconductors 1 to 6 according to Example had good wear resistance, good electrical properties, and good cleaning properties. This was attributed to the fact that each of photoconductors 1 to 6 contained a layered carbide so that the light transmittance of the charge transport layer at a wavelength of 350 to 380 nm fell within the range of 20 to 98%.

Example 2

In Example 2, photoconductors having a conductive support, an intermediate layer, a photosensitive layer, and a surface layer were tested for wear resistance, electrical properties, and cleaning properties.

1. Fabrication of Photoconductors (Fabrication of Photoconductor 9)

The preparation of the conductive support, the formation of the intermediate layer, and the formation of the charge generation layer were performed in the same manner as for photoconductor 1.

(1) Formation of Charge Transport Layer

The components listed below were mixed and dissolved in the indicated amounts to prepare a third coating solution.

| | |
|---|---|
| Charge transport material | 70 parts by weight |
| Resin binder | 100 parts by weight |
| Antioxidant | 8 parts by weight |
| Tetrahydrofuran/toluene (weight ratio: 8/2) | 750 parts by weight |

The charge transport material used was 4-methoxy-4'-(4-methyl-α-phenylstyryl)triphenylamine. The resin binder used was bisphenol Z type polycarbonate (IUPILON-Z300; Mitsubishi Gas Chemical Company, Inc.). The antioxidant used was IRGANOX 1010 (manufactured by BASF SE; "IRGANOX" is the registered trademark of this company).

The third coating solution prepared was applied onto the charge generation layer by dip coating and was dried in an oven at 120° C. for 70 minutes. A 20-μm-thick charge transport layer was thus formed on the surface of the charge generation layer.

(2) Formation of Surface Layer

The components listed below were used as the components of a fourth coating solution.

| | |
|---|---|
| Resin binder | 100 parts by weight |
| Polymerization initiator | 10 parts by weight |
| Layered carbide | 0.5 parts by weight |
| Metal oxide | 85 parts by weight |
| Tetrahydrofuran/2-butanol (weight ratio: 10/1) | 440 parts by weight |

The resin binder (polyfunctional radical polymerizable compound) used was trimethylolpropane trimethacrylate (SR350; SARTOMER JAPAN INC.). The polymerization initiator used was a photopolymerization initiator (IRGACURE 819; BASF Japan Ltd.). The layered carbide used was a graphene nanopowder whose particles have a longitudinal diameter of 5 μm (G-14; EM Japan Co., Ltd.).

First, 5 g of tin oxide ($SnO_2$) having a number average primary particle size of 20 nm was added to 30 mL of methanol, and dispersed using US homogenizer for 30 minutes. Next, 0.35 g of 3-methacryloxypropyltrimethoxysilane (KBM 503; Shin-Etsu Chemical Co., Ltd.) as a coupling agent and 10 mL of toluene were added to the dispersion, which was stirred at room temperature for 1 hour. This was followed by removal of the solvent using an evaporator and then by heating at 120° C. for 1 hour, thus preparing a surface-treated metal oxide having been surface-treated with the coupling agent. Subsequently, the surface-treated metal oxide particles, the resin binder, the layered carbide, and the solvent were mixed under light shielding conditions, and the mixture was stirred using a sand mill as a dispersing machine for 5 minutes. Next, the polymerization initiator was added to the stirred mixture, which was further stirred under light shielding conditions to dissolve the polymerization initiator. The fourth coating solution was thus prepared.

The fourth coating solution prepared was applied using a slide hopper type coater to the outer peripheral surface of the conductive support on the surface of which the charge transport layer was formed. The application was followed by ultraviolet irradiation using a metal hydro lamp for 1 minute. A 3.0-μm-thick surface layer was thus formed on the surface of the charge transport layer.

(Photoconductor 10)

Photoconductor 10 was fabricated in the same manner as photoconductor 9, except for replacing surface-treated metal oxide No. 1 with surface-treated metal oxide particles No. 2 listed in Table 4. Surface-treated metal oxide particles No. 2 used were surface-treated metal oxide particles prepared by substituting copper aluminate ($CuAlO_2$) for tin oxide ($SnO_2$).

(Photoconductor 11)

Photoconductor 11 was fabricated in the same manner as photoconductor 9, except for replacing surface-treated metal oxide No. 1 with surface-treated metal oxide particles No. 3 listed in Table 4. Surface-treated metal oxide particles No. 3 used were surface-treated metal oxide particles prepared by substituting titanium oxide ($TiO_2$) for tin oxide ($SnO_2$).

(Photoconductor 12)

Photoconductor 12 was fabricated in the same manner as photoconductor 9, except for replacing layered carbide No. 1 with layered carbide No. 6 with a thickness of 0.5 nm listed in Table 4. Layered carbide No. 6 used was a graphene nanopowder (G-10S; EM Japan Co., Ltd.).

(Photoconductor 13)

Photoconductor 13 was fabricated in the same manner as photoconductor 9, except for replacing layered carbide No. 1 with layered carbide No. 5 with a thickness of 100 nm listed in Table 4.

(Photoconductor 14)

Photoconductor 14 was fabricated in the same manner as photoconductor 9, except for replacing layered carbide No. 1 with layered carbide No. 7 with a longitudinal diameter of 0.1 μm listed in Table 4. Layered carbide No. 7 used was a graphene nanopowder (G-32; EM Japan Co., Ltd.).

(Photoconductor 15)

Photoconductor 15 was fabricated in the same manner as photoconductor 9, except for replacing layered carbide No. 1 with layered carbide No. 2 with a longitudinal diameter of 50 μm listed in Table 4.

(Photoconductors 16 and 17)

Photoconductors 16 and 17 were fabricated in the same manner as photoconductor 9, except for changing the amount of the layered carbide to 0.01 parts by weight for photoconductor 16 and 20 parts by weight for photoconductor 17 as shown in Table 4.

(Photoconductor 18)

Photoconductor 18 was fabricated in the same manner as photoconductor 9, except for replacing layered carbide No. 1 with layered carbide No. 8 with a longitudinal diameter of 0.05 μm listed in Table 4. Layered carbide No. 8 used was a graphene nanopowder (G-26; EM Japan Co., Ltd.).

(Photoconductor 19)

Photoconductor 19 was fabricated in the same manner as photoconductor 9, except for changing the amount of the layered carbide to 30 parts by weight as shown in Table 4.

(Photoconductor 20)

Photoconductor 20 was fabricated in the same manner as photoconductor 9, except for using a non-surface-treated metal oxide as shown in Table 4.

(Photoconductor 21)

Photoconductor 21 was fabricated in the same manner as photoconductor 9, except for not adding any layered carbide as shown in Table 4.

(Photoconductor 22) Photoconductor 22 was fabricated in the same manner as photoconductor 9, except for replacing layered carbide No. 1 with vermiculite listed in Table 4.

Table 4 lists: the layered carbides, resin binder, and surface-treated metal oxide particles which were used to fabricate photoconductors 9 to 22; and the light transmittance of the surface layers.

TABLE 4

| | | Layered carbide | | | | | Surface-treated metal oxide particles | | | | |
|---|---|---|---|---|---|---|---|---|---|---|---|
| Category | Photo-conductor No. | Layered carbide No. | Thickness (nm) | Longi-tudinal diameter (μm) | Amount (parts by weight) | Polymerizable compound | Surface-treated metal oxide No. | Metal oxide particles | Surface treating agent | Amount (parts by weight) | Light trans-mittance (%) |
| Example | Photo-conductor 9 | 1 | 20 | 5 | 0.5 | SR350 | 1 | $SnO_2$ | KBM503 | 100 | 96.5 |
| | Photo-conductor 10 | 1 | 20 | 5 | 0.5 | SR350 | 2 | $CuAlO_2$ | KBM503 | 80 | 73.1 |
| | Photo-conductor 11 | 1 | 20 | 5 | 0.5 | SR350 | 3 | $TiO_2$ | KBM503 | 100 | 61.3 |
| | Photo-conductor 12 | 6 | 0.5 | 5 | 0.5 | SR350 | 1 | $SnO_2$ | KBM503 | 100 | 97.3 |
| | Photo-conductor 13 | 5 | 100 | 5 | 0.5 | SR350 | 1 | $SnO_2$ | KBM503 | 100 | 86 |
| | Photo-conductor 14 | 7 | 20 | 0.1 | 0.5 | SR350 | 1 | $SnO_2$ | KBM503 | 100 | 97.7 |
| | Photo-conductor 15 | 2 | 20 | 50 | 0.5 | SR350 | 1 | $SnO_2$ | KBM503 | 100 | 95.7 |

TABLE 4-continued

| Category | Photo-conductor No. | Layered carbide: Layered carbide No. | Layered carbide: Thickness (nm) | Layered carbide: Longi-tudinal diameter (μm) | Layered carbide: Amount (parts by weight) | Polymerizable compound | Surface-treated metal oxide particles: Surface-treated metal oxide No. | Surface-treated metal oxide particles: Metal oxide particles | Surface-treated metal oxide particles: Surface treating agent | Surface-treated metal oxide particles: Amount (parts by weight) | Light trans-mittance (%) |
|---|---|---|---|---|---|---|---|---|---|---|---|
| | Photo-conductor 16 | 1 | 20 | 5 | 0.01 | SR350 | 1 | $SnO_2$ | KBM503 | 100 | 96.8 |
| | Photo-conductor 17 | 1 | 20 | 5 | 20 | SR350 | 1 | $SnO_2$ | KBM503 | 100 | 24.5 |
| Comparative Example | Photo-conductor 18 | 8 | 20 | 0.05 | 0.5 | SR350 | 1 | $SnO_2$ | KBM503 | 100 | 99.4 |
| | Photo-conductor 19 | 1 | 20 | 5 | 30 | SR350 | 1 | $SnO_2$ | KBM503 | 100 | 7.1 |
| | Photo-conductor 20 | 1 | 20 | 5 | 0.5 | SR350 | — | $SnO_2$ | — | 100 | (1) |
| | Photo-conductor 21 | — | — | — | — | SR350 | 1 | $SnO_2$ | KBM503 | 100 | 99.1 |
| | Photo-conductor 22 | | Vermiculite | | 0.5 | SR350 | 1 | $SnO_2$ | KBM503 | 100 | 86.4 |

(1) Falling outside the predetermined range of 20 to 98% at a wavelength of 350 to 800 nm 2. Evaluation of Photoconductors Photoconductors 9 to 22 were evaluated for wear resistance, electrical properties, and cleaning properties in the same manner as in Example 1.

For photoconductors 9 to 22, Table 5 shows the category, the photoconductor number, the evaluation results of wear resistance, the evaluation results of electrical properties, and the evaluation results of cleaning properties.

TABLE 5

| Category | Photoconductor No. | Evaluation items: Wear resistance | Evaluation items: Electrical properties | Evaluation items: Cleaning properties |
|---|---|---|---|---|
| Example | Photoconductor 9 | A | A | A |
| | Photoconductor 10 | B | A | B |
| | Photoconductor 11 | B | B | B |
| | Photoconductor 12 | B | A | A |
| | Photoconductor 13 | A | C | B |
| | Photoconductor 14 | C | B | B |
| | Photoconductor 15 | A | B | C |
| | Photoconductor 16 | C | A | B |
| | Photoconductor 17 | A | B | C |
| Comparative Example | Photoconductor 18 | D | B | C |
| | Photoconductor 19 | D | D | D |
| | Photoconductor 20 | D | B | D |
| | Photoconductor 21 | D | C | D |
| | Photoconductor 22 | D | D | D |

As shown in Table 5, photoconductor 18 according to Comparative Example had too high a light transmittance and hence poor wear resistance. This was attributed to the fact that the longitudinal diameter of the layered carbide was short and that the amount of the layered carbide was small. Photoconductor 19 according to Comparative Example had too low a light transmittance and hence poor wear resistance, poor electrical properties, and poor cleaning properties. This was attributed to the fact that the amount of the layered carbide was too large. Photoconductor 20 according to Comparative Example, in which a non-surface-treated metal oxide was used, had a light transmittance falling outside the predetermined range. Photoconductor 20 according to Comparative Example had poor wear resistance and poor cleaning properties. Photoconductor 21 according to Comparative Example had a high light transmittance and hence poor wear resistance and poor cleaning properties, which was attributed to the fact that no layered carbide was contained. Photoconductor 22 according to Comparative Example had poor wear resistance, which was attributed to the fact that the vermiculite has lower strength than the layered carbides. Photoconductor 22 according to Comparative Example had poor electrical properties, which was attributed to the fact that the conductivity of the vermiculite is lower than the conductivity of the layered carbides. The poor cleaning properties of Photoconductor 22 were attributed to the fact that the vermiculite has higher polarity than the layered carbides.

By contrast, photoconductors 9 to 17 according to Example had good wear resistance, good electrical properties, and good cleaning properties. This was attributed to the fact that each of photoconductors 9 to 17 contained a layered carbide so that the light transmittance of the charge transport layer at a wavelength of 350 to 800 nm fell within the range of 20 to 98%.

INDUSTRIAL APPLICABILITY

The present invention allows an electrographic photoconductor for electrophotographic image forming apparatuses to have improved wear resistance, scratch resistance, and cleaning properties and exhibit such properties over a long period of time. The present invention is therefore expected to provide higher durability and more widespread use of electrophotographic image forming apparatuses.

What is claimed is:

1. An electrographic photoconductor comprising a conductive support and a photosensitive layer disposed on the conductive support, the photosensitive layer containing a charge generation material and a charge transport material, wherein a layer forming the surface of the electrographic photoconductor contains a resin binder forming the layer and a layered carbide dispersed in the resin binder, the layered carbide comprises graphene as a structural unit, the layer forming the surface has a light transmittance in the range of 20 to 98% at a wavelength of 350 to 800 nm, and in a plane direction of the layered carbide, a ratio of a maximum dimension to a minimum dimension of the layered carbide is in the range of 1 to 10.

2. The electrographic photoconductor according to claim 1, wherein the layered carbide has a thickness in the range of 0.5 to 100 nm.

3. The electrographic photoconductor according to claim 1, wherein the layered carbide is contained in the layer forming the surface in an amount in the range of 0.05 to 20 parts by weight per 100 parts by weight of the resin binder.

4. The electrographic photoconductor according to claim 1, wherein the layer forming the surface is disposed on the photosensitive layer.

5. The electrographic photoconductor according to claim 4, wherein the resin binder is a cured polymer of a polymerizable compound.

6. The electrographic photoconductor according to claim 4, wherein the layer forming the surface contains metal oxide particles having a surface layer composed of a residue of a surface treating agent having a crosslinkable reactive group.

7. An image forming apparatus comprising: the electrographic photoconductor according to claim 1; a charging device that charges the surface of the electrographic photoconductor; a light exposing device that applies light to the charged surface of the electrographic photoconductor to form an electrostatic latent image; a developing device that feeds a toner to the electrographic photoconductor having the electrostatic latent image formed thereon to form a toner image; and a transfer device that transfers the toner image from the surface of the electrographic photoconductor to a recording medium, wherein the charging device is a contact charging device that contacts the surface of the electrographic photoconductor to apply a charging voltage.

8. An electrographic photoconductor comprising:

a conductive support;

a photosensitive layer disposed on the conductive support, the photosensitive layer containing a charge generation material and a charge transport material; and a surface layer disposed on the photosensitive layer, the surface layer containing a resin binder forming the layer, a layered carbide dispersed in the resin binder, and metal oxide particles having a surface layer composed of a residue of a surface treating agent having a crosslinkable reactive group, wherein the surface layer has a light transmittance in the range of 20 to 98% at a wavelength of 350 to 800 nm, and in a plane direction of the layered carbide, a ratio of a maximum dimension to a minimum dimension of the layered carbide is in the range of 1 to 10.

9. The electrographic photoconductor according to claim 8, wherein the layered carbide has a thickness in the range of 0.5 to 100 nm.

10. The electrographic photoconductor according to claim 8, wherein the layered carbide is contained in the layer forming the surface in an amount in the range of 0.05 to 20 parts by weight per 100 parts by weight of the resin binder.

11. The electrographic photoconductor according to claim 8, wherein the resin binder is a cured polymer of a polymerizable compound.

12. An image forming apparatus comprising: the electrographic photoconductor according to claim 8; a charging device that charges the surface of the electrographic photoconductor; a light exposing device that applies light to the charged surface of the electrographic photoconductor to form an electrostatic latent image; a developing device that feeds a toner to the electrographic photoconductor having the electrostatic latent image formed thereon to form a toner image; and a transfer device that transfers the toner image from the surface of the electrographic photoconductor to a recording medium, wherein the charging device is a contact charging device that contacts the surface of the electrographic photoconductor to apply a charging voltage.

* * * * *